US005714940A

United States Patent [19]

Fishovitz et al.

[11] Patent Number: 5,714,940

[45] Date of Patent: Feb. 3, 1998

[54] BELL ALARM FOR SYSTEM POWER BREAKER

[75] Inventors: Anthony J. Fishovitz, Freedom; Thomas K. Fogle, Pittsburgh, both of Pa.

[73] Assignee: Eaton Corporation, Cleveland, Ohio

[21] Appl. No.: 723,941

[22] Filed: Sep. 26, 1996

[51] Int. Cl.[6] ..... G08B 21/00

[52] U.S. Cl. ..... 340/638; 335/17; 324/424; 200/400

[58] Field of Search ..... 340/638, 635, 340/639; 335/17; 200/400; 324/424

[56] References Cited

U.S. PATENT DOCUMENTS

| | | | |
|---|---|---|---|
| 3,562,733 | 2/1971 | Murphy et al. | 340/638 |
| 3,955,162 | 5/1976 | Nicol | 335/17 |
| 4,114,005 | 9/1978 | Maier et al. | 200/153 |
| 5,192,941 | 3/1993 | Fishoitz et al. | 340/638 |

OTHER PUBLICATIONS

Instructions for the Systems Pow-R Breaker and Drawout Mechanism -400, 800, 1200, 1600, 2000C, 2500, 3000, 4000, 5000 Amp Frames -Effective Apr., 1994 -Style 6647C23H01.

*Primary Examiner*—Jeffery Hofsass
*Assistant Examiner*—Julie B. Lieu
*Attorney, Agent, or Firm*—Martin J. Moran

[57] ABSTRACT

A bell alarm system is provided for a circuit breaker in which the actuation of a flux shift trip device causes an electrical switch to be energized thus providing a bell alarm indication that the circuit breaker has been tripped. The flux trip device impinges against a pivotally rotated lower lever mechanism which has a knee which causes rotation of an upper lever against the influence of a spring attached between the two levers. As the knee moves along a surface of the upper lever mechanism, the relative rotation of the two lever members about their support pins is such as to cause the tension on the spring to increase. Because of this vibration in the circuit breaker itself or minute low level movements of the plunger mechanism will not cause the bell alarm to be actuated. The bell alarm will not be actuated until the aforementioned lower knee has rotated sufficiently far along the previously described surface to clear an upper knee in the upper lever mechanism thus allowing the force of the spring to cause the upper lever to actuate the bell alarm.

14 Claims, 2 Drawing Sheets

BELL ALARM FOR SYSTEM POWER BREAKER

BACKGROUND OF THE INVENTION

1. Field of the Invention

This invention relates to an overcurrent trip switch operable with a flux shunt trip device in a circuit breaker.

2. Background Information

Circuit breakers provide protection against overcurrent, ground faults and short circuits in an electrical power system. It is desirable to provide an alarm assembly in the circuit breaker to generate an audible or a visual signal that indicates the circuit breaker has tripped. The alarm assembly would inform the operator that a fault has occurred. Typically, these alarms have been electronically or mechanically controlled. With electronic alarms, switches are activated by an associated power relay module that is purely electronic. The trip unit sends a signal to the power relay module that sets the switches that control an audible alarm or a light indicator. The difficulty with such electronic devices is that they require control power. If power is lost in the system, the switches may-not activate under appropriate circumstances.

Mechanically controlled activating switches operate without the need for separate control power. Such mechanical switch devices are shown and described in U.S. Pat. Nos. 5,192,941 and 4,114,005 which are assigned to the assignee of the present application. The disadvantage associated with mechanically activated switching devices is they are susceptible to shock and vibration. During breaker operations, due to fault conditions, undesired vibrations may cause the mechanical switching device to prematurely move out of its activated position. Thus, the device may return to the reset position without input from the operator.

Some circuit breakers include a flux shunt trip mechanism. The flux shunt trip mechanism incorporates a permanent magnet. The device is a spring loaded plunger which when released to an extended position causes the circuit breaker to trip. Under normal conditions the plunger is maintained in a retracted position by the magnetic force of the permanent magnet. A trip coil is placed adjacent to the plunger. The trip coil is energized upon attaining a predetermined trip condition, and magnetic flux is thereby generated. This magnetic flux opposes the magnetic flux of the permanent magnet. The opposing flux cancels the magnetic flux of the permanent magnet and a spring force on the plunger then causes the plunger to move to its tripped position.

There remains a need for a mechanical device that interacts with the flux shunt trip mechanism that is not susceptible to shock and vibration. There is a further need for a device that does not allow the switch to return to the reset position after an interruption until manually reset by the operator.

SUMMARY OF THE INVENTION

These and other needs are satisfied by the device of the present invention which comprises a switching device for use with the flux shunt trip mechanism in the circuit breaker. The device is an alarm assembly which interacts with the plunge on the flux shunt trip device. The flux shunt trip device has a plunger which is movable between an extended position and a retracted position. A trip coil is energized upon a predetermined trip condition which generates a magnetic flux. The flux of the permanent magnet normally retains the plunger in its retracted position. However, when the flux is opposed by the flux of the energized coil the spring loaded plunger is forced into its extended position. In this position, the plunger activates a trip mechanism which interrupts current through the circuit breaker. The plunger has an annular shoulder of greater diameter than the body portion of the plunger. The present invention provides an actuating member which is preferably a latch arm member which interacts with the annular shoulder of the plunger on the flux shunt trip device. When the plunger moves to its extended position, its annular shoulder engages the latch arm member causing the actuating member to rotate to its actuating position. The present invention also provides a switch tripping member, preferably a lever member that interacts with the latch arm member to trip the alarm.

A conventional switch is mounted with respect to the lever member so that when the lever member moves to its actuated position the switch is activated. It is desirable that the lever be maintained in the actuated position until it is manually reset to its initial position by the operator. Thus, the lever member and the latch arm member are constructed so that the lever member will remain in the actuated position even though the plunger returns to its initial retracted position. In one embodiment of the invention a latch member includes a flat surface and a lever member with a flat surface and an arcuate surface. Under normal operating conditions, the flat surface of the latch member abuts the flat surface of the lever member. Under trip conditions, the flat surface of the latch member moves with increasing resistance against the flat surface of the lever member until the flat surface of the latch member enters the arcuate surface of the lever member. A biasing means causes the lever member to actuate the switch and maintains the lever in its actuated position until manually reset by the operator.

In order to reset the circuit breaker, a plate is provided which cooperates with a push-button located on the outside panel of the circuit breaker. The plate is mounted so that it will move towards the lever member when the push-button is actuated. A protrusion on the lever member is engaged by the plate forcing the lever member to return to its initial position. Biasing means forces the latch member to return to its initial position. This resets the latch member so that it may be engaged by the plunger on the occurrence of the next trip event.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENTS

Figure 1:
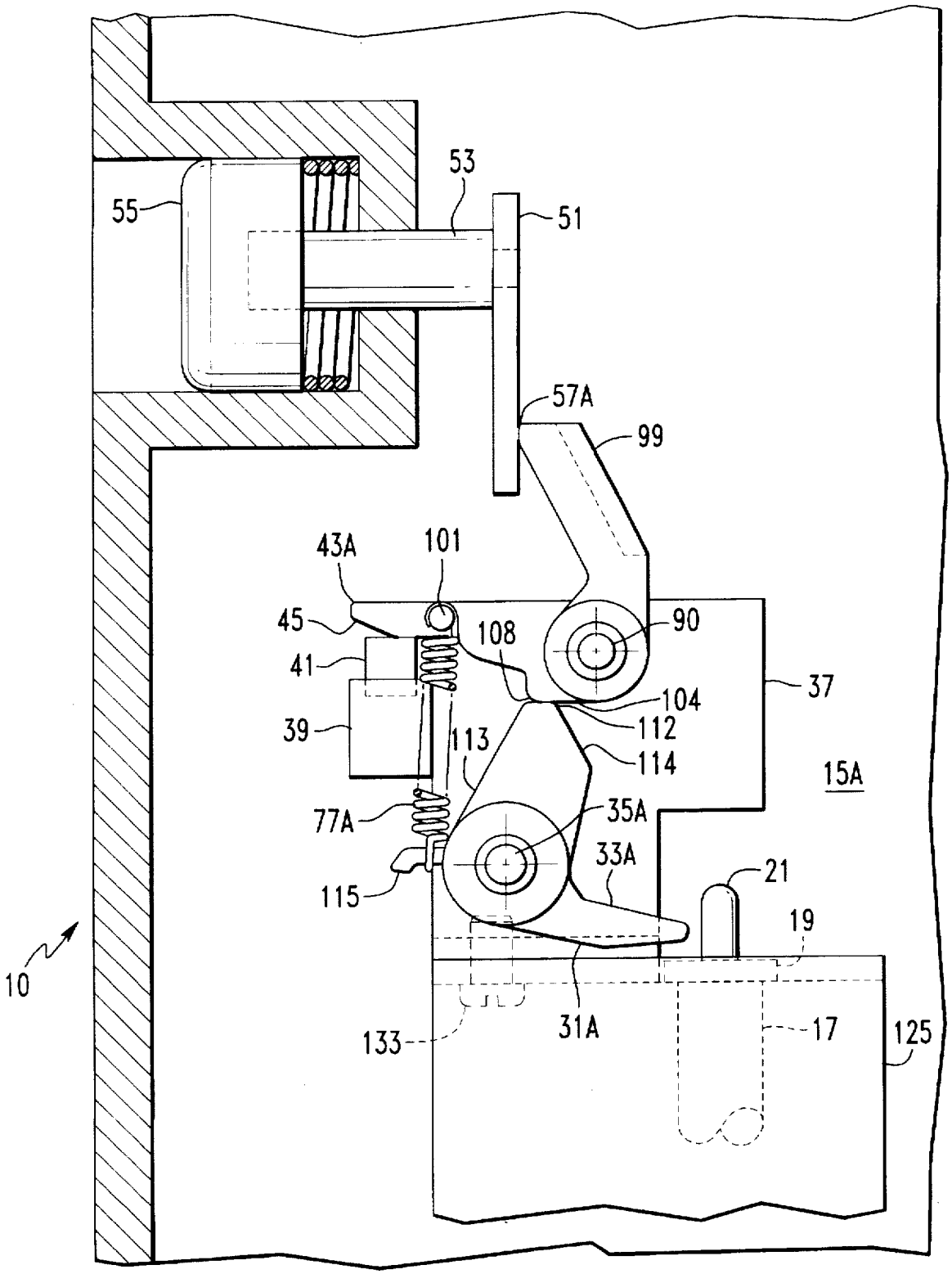
FIG. 1 is a schematic fragmentary vertical plan view partially broken away of an alarm assembly shown in the reset or latched position in a circuit breaker in accordance with the present invention.

Referring now to the drawing and FIG. 1 in particular, there is depicted a bell alarm or switch system for a circuit breaker. References is made to U.S. Pat. No. 5,192,941, issued Mar. 9, 1993 to Fishovitz et al, entitled OVERCURRENT TRIP SWITCH and to U.S. Pat. No. 4,114,005, issued Sep. 12, 1978 to Maier et al, entitled CIRCUIT BREAKER SPRING ASSEMBLY which are incorporated herein by reference. In particular there is provided a portion of an external housing 10 for a circuit breaker which may be, for example, an insulated case circuit breaker such as shown and disclosed in U.S. Pat. No. 4,111,005. In particular, there may be provided a shunt trip actuating device or actuator such as shown and described in U.S. Pat. No. 5,192,941 having a plunger 17 an annular ring 19 and a protrusion 21. These devices are contained within shunt trip mechanism bracket 125. Shunt trip mechanism bracket 125 is interconnected with bell alarm or switch bracket 37 by way of a screw or a similar fastening means 133. Disposed upon bell alarm bracket 37 are two pivot pins 35A and 90. Pivot pin 35A pivotally supports lower actuating lever 31A and pivot pin 90 pivotally supports upper actuating lever 99. Lower actuating lever 31A includes a leg 33A and an angularly disposed first actuating leg 113. First actuating leg 113 has disposed at an end thereof an actuating surface 114 and a lower knee 112. Upper actuating lever 99 includes a finger 57A and an arm 43A which is angularly displaced from finger 57A. Arm 43A has a surface 104 and an upper knee 108. Lower actuating lever 31A has an angularly displaced spring attachment member 115. Arm 43A also includes a spring attachment member 101. A spring 77A is disposed between the spring attachment member 115 and the spring attachment member 101. Spring 77A may be compressed or tensed in accordance with the relative angular dispositions of the arms 43A and 113 about their respective pivot pins or axises 90 and 35A respectively. Arm 43A has a surface 45 which impinges against an actuating bar 41 on an electric switch member 39. When the actuating bar 45 is depressed the electric switch member 39 is activated to provide an indication of activity. This would occur when the circuit breaker has been tripped, for example. There is also provided a push-button 55 in the external housing 10 which is interconnected with a connecting member 53 which in turn is attached to a plate 51 which may translate laterally axially of the connecting member 43 in such a manner as to physically contact finger 57A in certain instances thus causing a clockwise rotation of the upper actuating lever 99 in a manner which will be described hereinafter.

In FIG. 1, the flux shift device 15A is in such a disposition that the switch 39 is non-energized. In this disposition, the knee 112 of the lower actuating lever 31A is flush against the surface 104 of the upper arm lever 99 and the spring 77A remains tensed at a predetermined tension. Actuation of the flux shit device 15A causes the plunger 17, the protrusions 21 and the annular ring 19 to translate upwardly causing the annular ring 19 to strike the bottom of the leg 33A causing counter-clockwise rotation of the actuating lever 31A about its pin 35A. This rotation causes the knee 112 to move along the surface 104 toward the left causing the upper arm 99 to rotate in a clockwise direction against the force of spring 77A. This continues until the lower knee 112 clears the upper knee 108 in which case the upper knee 108 then rides against the surface 114 of the actuating lever 31A. In this arrangement as the knee 112 slides along the surface 104, the spring 77A is tensed providing greater force resisting the above mentioned movement. This will continue until the knee 112 clears the knee 108 in which case the spring 77A will be permitted to contact somewhat thus forcing the arm 43A to rotate downwardly or in a counter-clockwise direction against the bar 41 thus actuating the electric switch 39. In this disposition the surface 114 abuts against the knee 108 and it is prevented from returning to the position shown in FIG. 1 even though energy may be removed from the flux shunt trip 15A thus causing the plunger 17, the annular ring 19 and the protrusion 21 to translate in the opposite direction or downwardly as viewed in FIG. 1.

Figure 2:
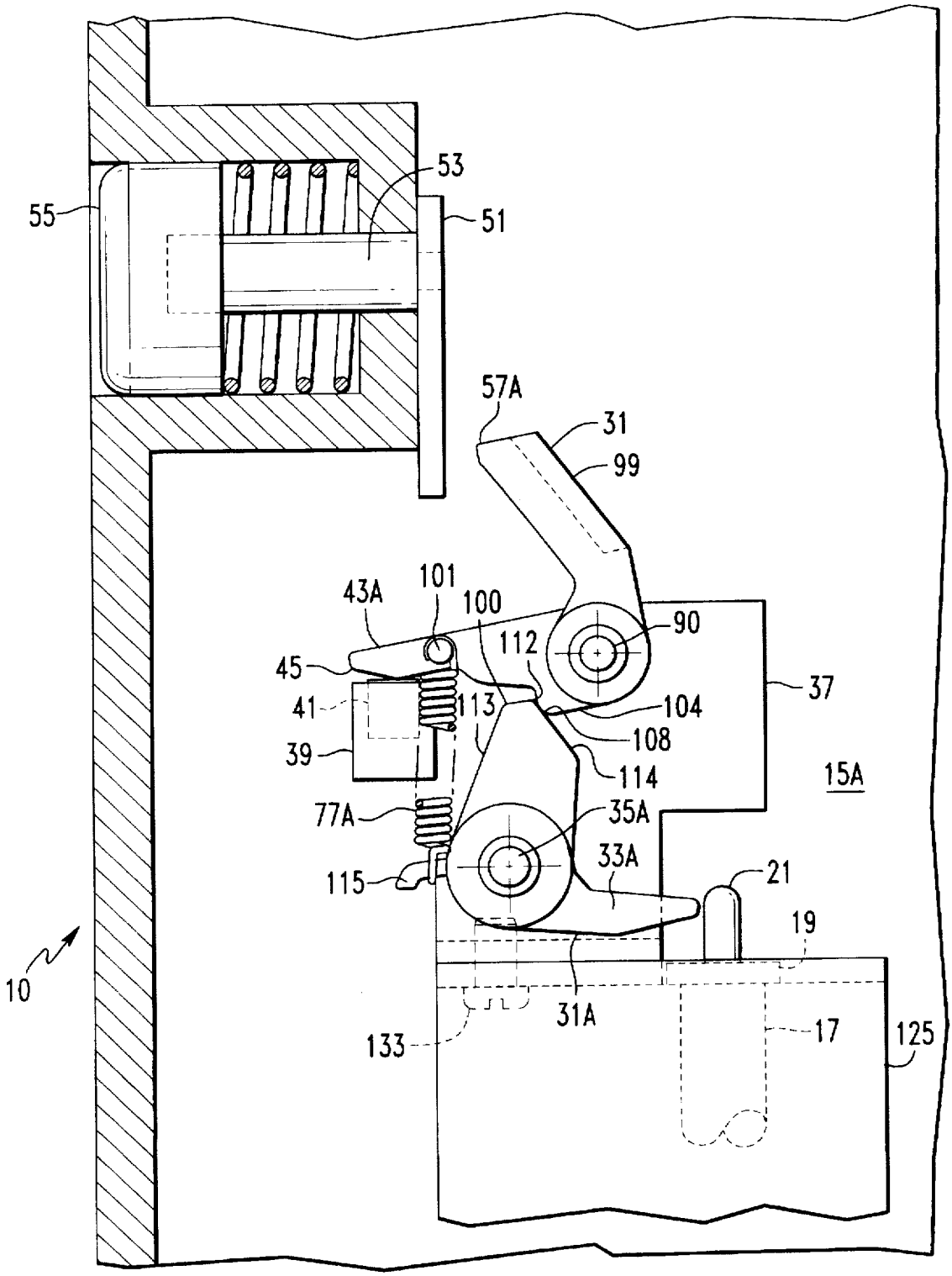
FIG. 2 is a similar view of the alarm assembly of FIG. 1 shown in the tripped position.

Referring now to FIG. 2, the aforementioned shunt trip device 15A is shown in the latched position. In this case the arm 43A has caused the bar 41 to be pushed downwardly into the switch 9 by the action of the surface 45 moving thereagainst. This energizes the switch 39 until a reset is activated. It is to be noted that the upper knee 108 is now resting against the surface 114 and the lower knee 112 is clear of the surface 104. The tension spring 77A maintains the two levers 99 and 31A in this disposition until reset. In order to reset, the push-button 55 is translated to the right by an operator so as to cause the connecting means 53 which is interconnected with the plate 51 to move the plate 51 in the rightward direction thus impinging against the left side of the finger 57A and causing the entire upper lever 99 to rotate in the clockwise direction so that the knee 108 slides against the surface 114 until the upper knee 108 clears the lower knee 112. The interconnection between the plate 51, the finger 57A, the rigidly attached arm 43A as it rotates about the pin 90 causes the actuating bar 41 to rise thus causing electrical contact to be interrupted within the switch 39 thus ending the alarm. At this point in time, the tension of the spring 77A acting on the freely movable actuating spring attachment member 115 allows the freely movable actuating lever 31A to be rotated in a clockwise direction to thus relieve the tension of the spring 77A. As this happens, the arrangement is reset into the disposition shown in FIG. 1 and is once again in a situation to be actuated by the upward movement of the plunger 17, the annular ring 19 and the protrusion 21 in the manner described previous hereinafter.

Referring once again to FIG. 1, it can be shown that a significant advantageous feature of this invention is the capability thereof to prevent activation of the switch or bell alarm 39 under the influence of vibration or similar movement. The reason for this is that the movement of the lower knee 112 against the surface 104 provides a dead band of action which resists actuation of the switch 39 even though there may be some marginal upward transitional movement or vibration of the plunger 17. No activation of switch 39 will occur until the lower knee 112 has been moved by the counter-clockwise rotation of the actuating lever 31A such that the lower knee 112 moves basically to the left along the surface 104 with respect to FIG. 1. Furthermore, movement of the knee 112 against the surface 104 causes the arm 43A to move away from the spring attachment member 115 thus introducing a higher degree of tension on the spring 77 thus causing increasing resistance for the movement of the knee 112 against the surface 104. Only if there is forceful significant movement of the plunger 17, the annular ring 19 and the attached protrusion 21 in an upward direction will the knee 112 clear the knee 108 under the influence of the increasingly tensed spring 77 thus causing an actuation of the electrical switch 39.

We claim:

1. A circuit interrupter comprising:

(a) separable contacts;

(b) an operating mechanism interconnected with said contacts for causing said separable contacts to separate under predetermined conditions;

(c) a housing for said contacts and said operating mechanism;

(d) a movable latch disposed in said housing having a flat surface;

(e) a movable lever disposed in said housing having a flat surface, an arcuate surface adjacent to said flat surface, and an actuating member;

(f) a switch disposed in said housing actuated by said actuating member;

(g) trip means disposed in said housing interconnected with said latch for moving said flat surface of said latch relative to said flat surface of said lever with increasing resistance until said flat surface of said latch abuts said arcuate surface causing said lever to move under a lever force thereby causing said actuating member to actuate said switch; and (h) reset means disposed in said housing interconnected with said lever.

2. The combination as claimed in claim 1, wherein said movable lever rotates about an axis.

3. The combination as claimed in claim 2, wherein said lever rotates in a first rotational direction in response to said movement of said movable latch and moves in an opposite rotational direction to actuate said switch.

4. The combination as claimed in claim 2, wherein said reset means rotates said lever when actuated externally thereby causing said actuating member to move said switch to the reset position.

5. A circuit interrupter comprising:

(a) separable contacts;

(b) an operating mechanism interconnected with said contacts for causing said separable contacts to separate under predetermined conditions;

(c) a housing for said contacts and said operating mechanism;

(d) a movable latch disposed in said housing having a flat surface;

(e) a movable lever disclosed in said housing having a flat surface, an arcuate surface adjacent to said flat surface, and an actuating member;

(f) a switch disposed in said housing actuated by said actuating member;

(g) biasing means disposed in said housing connected to said lever and to said latch;

(h) trip means disposed in said housing interconnected with said latch for moving said fiat surface of said latch relative to said flat surface of said lever with increasing resistance until said flat surface of said latch abuts said arcuate surface causing said lever to move under a lever force thereby causing said lever to move under a lever force thereby causing said actuating member to actuate said switch; and (i) reset means disposed in said housing interconnected with said lever.

6. The combination as claimed in claim 5, wherein said latch rotates about an axis and said lever rotates about an axis.

7. The combination as claimed in claim 6, wherein said biasing means increases the force required to rotate said latch.

8. The combination as claimed in claim 6, wherein said trip means causes said latch to rotate which causes said biasing means causes said lever to rotate in an opposite rotational direction allowing said flat surface of said latch to enter said arcuate surface of said lever thereby allowing said actuating member to actuate said switch.

9. The combination as claimed in claim 5, wherein said circuit interrupter is operable in a tripped position and a reset position.

10. The combination as claimed in claim 9, wherein said reset means rotates said lever when actuated externally.

11. The combination as claimed in claim 9, wherein said biasing means rotates said latch to the reset position.

12. The combination as claimed in claim 9, wherein said flat surface of said lever abuts said flat surface of said latch when said circuit interrupter is in the reset position.

13. The combination as claimed in claim 9, wherein said biasing means prevents said latch from rotating to said reset position when said circuit interrupter is in said tripped position.

14. A circuit comprising:

(a) separable contacts;

(b) an operating mechanism interconnected with said contacts for causing said separable contacts to separate under predetermined conditions;

(c) a housing for said contacts and said operating mechanism;

(d) a movable latch disposed in said housing having a flat surface;

(e) a movable lever disposed in said housing having a flat surface, an arcuate surface adjacent to said flat surface, and an actuating member;

(f) said latch rotates about an axis and said lever rotates about an axis;

(g) a switch disposed in said housing actuated by said actuating member;

(h) biasing means disposed in said housing connected to said lever and to said latch, said biasing means increases the force required to rotate said latch;

(i) said circuit interrupter is operable in a tripped position and a reset position;

(j) trip means disposed in said housing interconnected with said latch, said trip means causes said latch to rotate thereby causing said lever to rotate in a first rotational direction and said biasing means rotates said lever in an opposite rotational direction, the rotation of said latch causes said flat surface of said latch to move relative to said flat surface of said lever with increasing resistance until said flat surface of said latch abuts said arcuate surface of said lever thereby causing said lever to move under a lever force which allows said actuating member to actuate said switch;

(k) reset means disposed in said housing interconnected with said lever, said reset means rotates said lever when actuated externally thereby causing said biasing means to rotate said latch until said flat surface of said lever abuts said flat surface of said latch;

(l) said biasing means prevents said latch from rotating to said reset position when said circuit interrupter is in said tripped position.

* * * * *